United States Patent [19]

Shah et al.

[11] Patent Number: 4,785,915

[45] Date of Patent: Nov. 22, 1988

[54] ELEVATOR SYSTEM MONITORING COLD OIL

[75] Inventors: Denis D. Shah, Union, N.J.; Richard L. Thomas, Slocum Township, Luzerne County, Pa.

[73] Assignee: Westinghouse Electric Corp., Pittsburgh, Pa.

[21] Appl. No.: 64,915

[22] Filed: Jun. 19, 1987

[51] Int. Cl.[4] ..... B66G 1/04

[52] U.S. Cl. ..... 187/110

[58] Field of Search ..... 187/110, 111

[56] References Cited

U.S. PATENT DOCUMENTS 3,530,958 9/1970 Brannon et al. ..... 187/110 X 4,162,718 7/1979 Lamprey ..... 187/110

FOREIGN PATENT DOCUMENTS 53-145252 12/1978 Japan ..... 187/111

*Primary Examiner*—William M. Shoop, Jr.

*Assistant Examiner*—W. E. Duncanson, Jr.

*Attorney, Agent, or Firm*—J. L. Bruzslek

[57] ABSTRACT

A hydraulic elevator system for monitoring a cold oil thermostat mounted on a hydraulic oil reservoir to prewarm the oil prior to passenger service by recirculating the oil in the reservoir through a pumping path which goes past up and down valves, thus bypassing the hydraulic jack. A control circuit including a microprocessor generally controls all car and corridor functions and is photo-coupled to the thermostat for an input signal which interacts with a program module in a random access memory which is run in sequence by the microprocessor. The program module provides a minimum timer phase for pump motor energization which is short but normally adequate to circulate the oil to standard minimum operating temperature before the sequencing activates a maximum timer phase which is cumulative in time for continuous bypassing until shutdown. The tiered total timer counting thus prevents overtemperature problems to avoid damage to the pump motor windings if the thermostat fails and also prevents recycling.

11 Claims, 4 Drawing Sheets

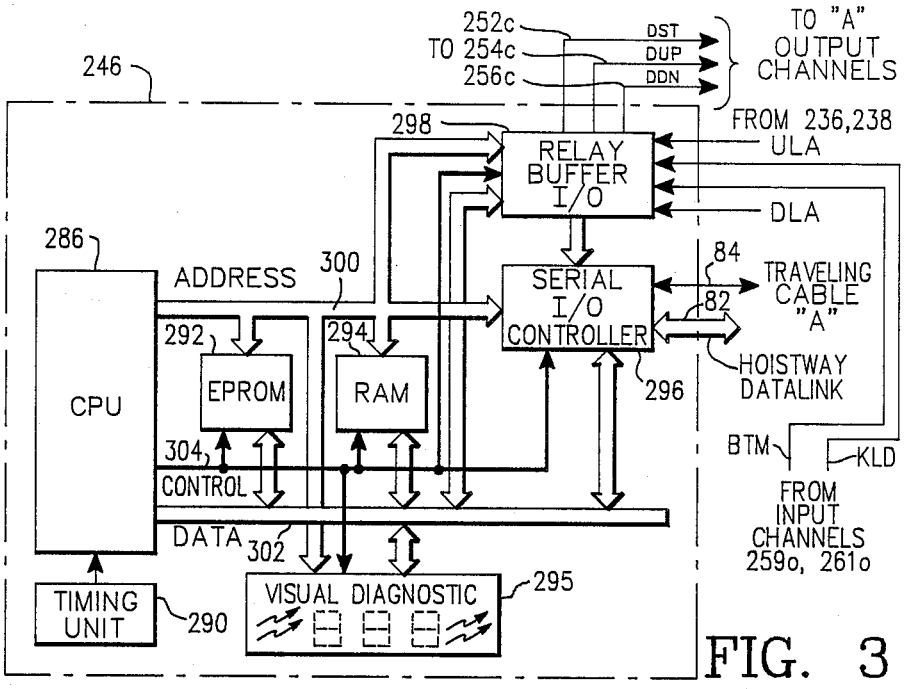
FIG. 3
COLD OIL THERMOSTAT
| | |
|---|---|
| 0 0 | OIL NOT COLD |
| 0 1 | OIL COLD |
FIG. 4A
COLD OIL FLAG
| | |
|---|---|
| 0 0 | EXPIRED |
| 0 1 | BYPASSING OIL |
| 1 0 | MIN EXPIRED |
| 1 1 | (NOT USED) |
FIG. 4B
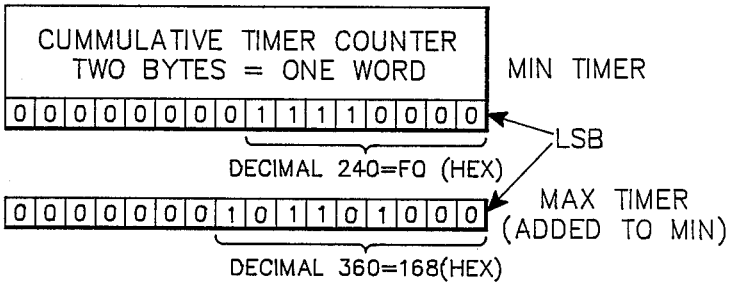
FIG. 4C

ELEVATOR SYSTEM MONITORING COLD OIL

CROSS REFERENCE TO OTHER APPLICATIONS

The present application is related to the following concurrently filed U.S. patent applications filed Oct. 16, 1987, Ser. No. 07/109,639, by J. W. Blain, et al. and entitled "Elevator System Graceful Degradation of Bank Service"; Ser. No. 07/109,638, by J. W. Blain, et al. and entitled "Elevator System Master Car Switching"; Ser. No. 07/109,640, by J. W. Blain et al. and entitled "Elevator System Adaptive Time-based Block Operation"; and Ser. No. 07/064,913, filed June 19, 1987, by J. W. Blain et al. and entitled "Elevator System Leveling Safeguard Control and Method", all of which are assigned to the same as the present assignee and the disclosures of which are incorporated herein by reference.

BACKGROUND OF THE INVENTION

1. Field of the Invention

This invention relates in general to hydraulic elevator systems, and more particularly, to a hydraulic elevator system with a hydraulic oil reservoir recirculation path which thermostatically interacts with a local microprocessor elevator controller.

2. Description of the Prior Art

Microprocessors may be pre-programmed to perform various functions in the operational control or management of a hydraulic elevator system. Conventional hardware arrangements for elevator configurations have been known to benefit from these state-of-the-art solid-state controllers, but newly defined tasks involving uniquely reconfigured hardware arrangements have yet to emerge. Remotely present is the likelihood of failure of components such as thermostats used with the present day elevator control apparatus although it has been minimized by testing procedures, statistical use extensions, and appropriate service inspections with periodic replacements.

There is a historical recognition in accident prevention that many types of failure modes can be prevented. The codification of same and the need to meet the elevator safety code requirements is given primary recognition in the implementation of elevator car running functions, door control functions and car call and corridor call functions which are of colossal concern. In the prior art of automatic temperature control for the heating of the hydraulic oil used to drive a hydraulic elevator jack, the job of heating the oil to a minimum operating temperature has been done by a heater or heating coil in the area surrounding the oil reservoir. A thermostat or thermocouple has been used to sense the temperature and to initiate shutting off the associated power transformer for the heater when the temperature of the oil is near the standard. An overtemperature condition of the oil must be avoided since this condition presents a safety hazard and will result in shutting down the hydraulic elevator system and may damage the pump motor windings which is directly affected by it.

With the introduction of microprocessor based elevator controllers, the compliance with the safety codes has gradually shifted to implementation of the codes by programs which can cycle through an over temperature safety checking function in a very short time interval. This improvement does not, however, solve the problem inherent in operating the heater which still presents overshoots of temperature since the oil is not uniformly without temperature gradients, and the art of thermostatic control requires external apparatus and feedback circuits in order to deal with this problem.

One of the principal problems with a hydraulic elevator system of the type described above is that bulky heating coils connected with special power transformers and switching circuits are required in order to get the job done of heating the oil up to the operating temperature, and these components require space in the machine room where space is at a premium. They give off excessive heat to the adjacent area which heat must usually be dissipated, and they are costly to install and to replace if they fail.

Yet another problem present with external heaters is that the thermostat may fail and give a false signal for either coil oil or maximum temperature limits, and the heater circuit may not monitor this false signal quickly enough to avoid the damage to the pump windings or to detect when the shut down is necessary. Another problem in need of a solution is at the edge of the standard temperature where a flickering cold oil thermostat could damage the heater circuit apparatus by causing it to cycle in and out of service at a damaging frequency.

SUMMARY OF THE INVENTION

The present invention is a new and improved elevator system of the hdyraulic drive type, along with a method of detecting and operationally obviating a condition of hydraulic oil being at an operating temperature below an established minimum value. A thermostat responsive to the temperature of the oil in a hydraulic oil reservoir signals by a contact closure that the temperature of oil is below the operational standard, and this status is communicated to a control circuit microprocessor.

The microprocessor implements a program to inactivate an in-service, available elevator car, at the bottom floor with its door signaled to the closed position. A hydraulic drive pump driven from its connected motor is then activated, to pass the oil past de-energized up and down control valves, to warm the oil by continuously bypassing a hydraulic jack which otherwise is active to drive the car upwardly and downwardly in its normal operation with the control valves otherwise controlling the flow of oil through the hydraulic jack.

Further in accordance with the invention, a hydraulic elevator system is provided wherein the program which the microprocessor implements provides a stabilizing effect in reducing the need for recycling of the pump motor for warming the oil in order to prevent damage to the motor and an associated line starter, providing voltage for starting the motor.

An interactive program timer module provides a sequence of timing counts which includes a minimum timer phase which precedes and is cumulative with a maximum timer phase which is brought into the sequencing of the timing counts only if the status of the thermostat signal continues to indicate a cold oil condition after the minimum timer phase has expired. The interactive program timer module also provides an exiting sequence that prevents a failure of the thermostat signal for cold oil from causing overheating of the oil to an over temperature condition after the maximum timer phase has expired.

BRIEF DESCRIPTION OF THE DRAWINGS

The invention may be better understood, and further advantages and uses thereof more readily apparent when considered in view of the following detailed description of exemplary embodiments taken with the accompanying drawings in which:

FIG. 3 is a block diagram of a microcomputer circuit which may be used in the elevator system of FIGS. 1 and 2 in order to implement a program module sequence which provides for warming the oil.

FIGS. 4A, 4B, 4C each form a portion of a RAM map illustrating storage locations of a certain system parameter, status program related semaphores, and timer program words.

DESCRIPTION OF A PREFERRED EMBODIMENT

The invention is a new and improved hydraulic elevator system, along with a method of detecting and correcting low and marginal temperature hydraulic oil in the system by operationally recirculating the oil local to the oil reservoir prior to normal service passenger operation, to warm the oil up to a minimum operational temperature which provides smooth starts when service is requested.

The new and improved system and method are described by illustrating only those parts of a hydraulic elevator system pertinent to the understanding of the invention, and supplemental portions of the elevator system have been incorporated by reference to a U.S. patent application assigned to the same assignee as the present application. Accordingly, U.S. patent application Ser. No. 07/064,913 filed concurrently herewith and entitled "Elevator System Leveling Safeguard Control and Method" describes a car controller which implements program control functions which incorporate elevator safety codes to ensure safe operations so that the elevator car is not allowed to move more than a limited distance away from a floor at which the doors of the car open.

Certain figures of the incorporated U.S. application are substantially similar to those referred to herein, and the reference to features and the numerals used are consistent for the most part with the exception of modified portions which concern the present invention as will become apparent from the following description.

Figure 1:
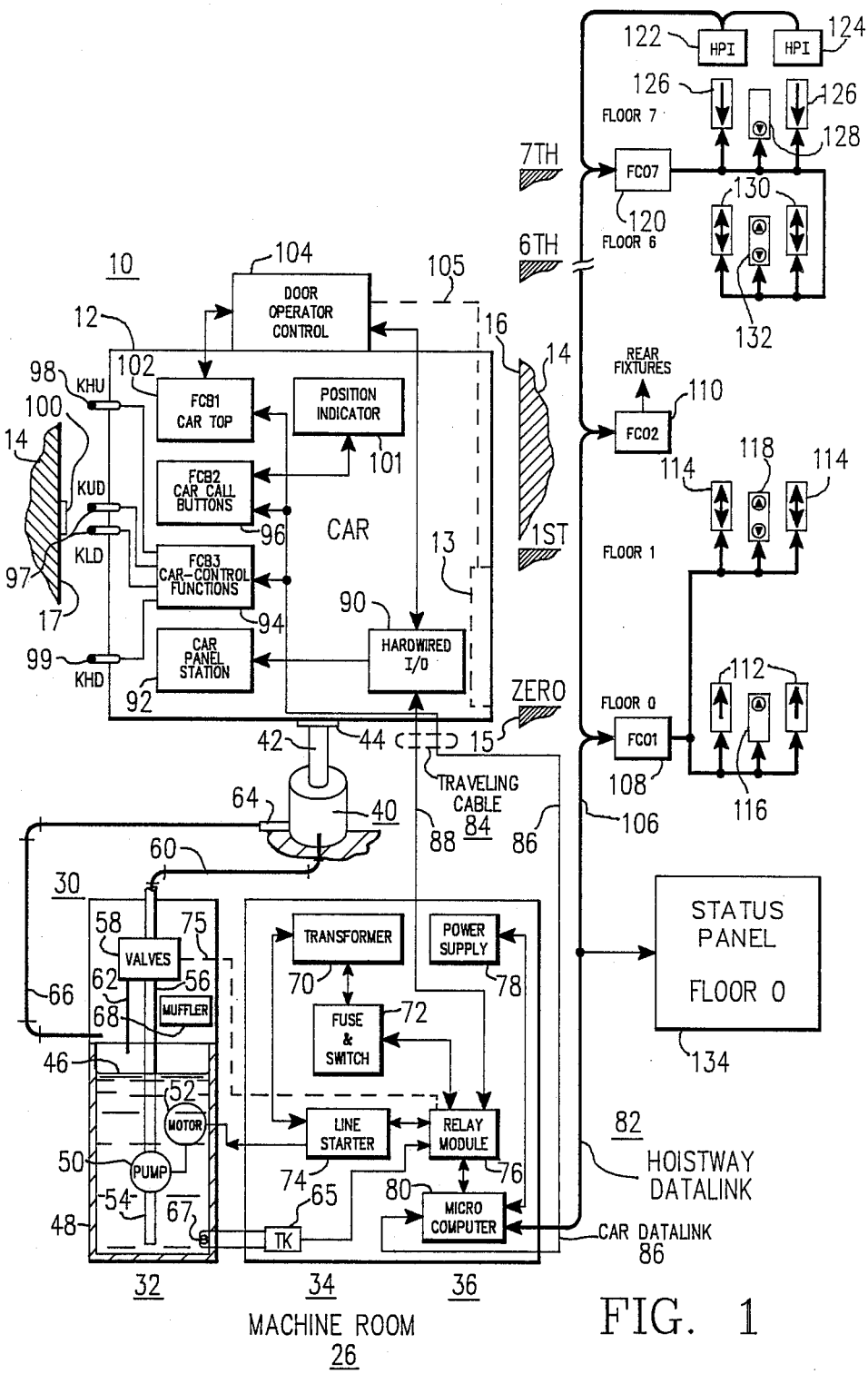
FIG. 1 is a block diagram of an elevator system driven by a hydraulic drive which may be constructed and operated according to the teaching of the invention.

More specifically, FIG. 1 shows a hydraulic elevator system 10 which may utilize the teachings of the present invention, the elevator system 10 includes one or more elevator care, such as car 12, the movement of which is driven as shown from below the car by components a machine room 26. The car 12 is driven in the building structure 14 having a plurality of landings 13, such as, the ZERO, 1ST, 6TH, and 7TH floors or landings being shown in order to simplify the drawing.

Car calls registered by pushbuttons 96 mounted on the car 12 and hall calls as registered by pushbuttons mounted in the hallway, such as the up pushbutton 116 located at FLOOR 0 are communicated respectively on CAR DATALINK 86 and HOISTWAY DATALINK 82 to provide bi-directional communication paths to the power and control electronics portion 36 located in a machine room 26. The calls are then processed in a microcomputer 80 which controls the movement of the car 12 from landing 15 to and from the other floors in the building structure 14. The machine room 26 also contains a power transfer circuit portion 34 which provides power and switching for the power and control electronics portion 36. This interconnected circuitry includes the relay module 76 which is later to be described with respect to FIG. 2.

The machine room 26 may be located in the basement or sub-basement of the building structure 14 in order to provide an appropriate direct driving relationship for the car 12 from a hydraulic power supply portion 32 which is also in the machine room 26. A hydraulic system 30 is thereby provided for an appropriate direct driving relationship to a hydraulic jack 40 which may have a single acting piston or plunger 42 which is fixed to a platen plate 44 centrally located on the underside of the car 12 in order to move the car according to the movement of the plunger 42 since the base of the jack 40 is anchored firmly to the ground or base of the building structure. A multi-stage or telescopic hydraulic jack 40 of the synchronized type which is suitable for use in hydraulic elevator systems also may be used as it is described in the incorporated U.S. application and which will be seen in FIG. 2 as further depicted herein.

The adaptation of the presently discussed FIG. 1 directly proceeds from the incorporated U.S. application which has a similar showing in FIG. 1 therein which shows a block diagram of an elevator system driven in the alternative with either traction or hydraulic drives. It is apparent that the present FIG. 1 is directed solely to the hydraulic system 30 for driving the elevator car 12. The hydraulic system 30 provides fluid power for operating jack 40, such as hydraulic oil 46 disposed in a reservoir 48 which is filled to a greater depth of oil which is significant because certain components of the hydraulic system 30 are submerged beneath level of the hydraulic oil 46. A hydraulic pump 50, driven by an electric motor 52, provides hydraulic oil into a pipe 54 and out of the pump 50 through intermediate pipe 56 and through a hydraulic elevator valve unit 58. A muffler 68 is strategically located with respect to the motor 52, the pump 50, and valves 58 so as to isolate the vibration of these components from reaching the elevator car 12 through the hydraulic jack 40 mechanical linkages which may otherwise transfer vibrations and deteriorate the performance of the system. The hydraulic pump 50 and the electric motor 52 are the components along with pipe 54 and a portion of intermediate pipe 56 which are submerged in the hydraulic oil 46 in the reservoir 48 and thus form a portion of a submersible power unit for this system. The microprocessor control with a submerged power unit of this system is a variation from the arrangement of the hydraulic system shown in the incorporated by reference U.S. application, although these two power systems may be used interchangeably in the hydraulic driven elevator system.

The valves 58 include a pipe section 62 for returning hydraulic oil to the reservoir 48, and there is also a return oil pipe 64 comprised of pipe sections 66 leading back to the reservoir 48 from the jack 40 in order to provide a path for oil which may leak past the seals in the plunger section 42. This may occur when hydraulic oil is introduced under pressure through supply pipe sections 60 to the input of jack 40. The pumping of hydraulic oil through an open UP valve in valve unit 58 with a closed DN valve in the unit is the normal course for hydraulic oil to flow through supply pipe section 60 into jack 40 to move the plunger 42 upwardly thereby driving the car 12 from landing 15 to the upper floors of the building, and the reverse opening position of the UP and DN valves is used when the car is called from an upper floor to a lower floor, with the excessive hydraulic oil flowing through the open DN value and back to the reservoir 48 through pipe 68.

The power transfer circuits 34 connect the pump motor 52 to a 3-phase source of alternating electric potential by way of a circuit breaker and line starter unit 74. The 3-phase pump motor has a suitable control voltage applied to it from the source of voltage via a transformer 70. A combined fuse and switching module 72 provides power line voltage for a relay module 76 which is connected with a lower voltage for logic circuits from a DC power supply 78. With one exception the remaining features of FIG. 1 and their function in the hydraulic elevator system 10 have been described with sufficient detail in the incorporated U.S. application to provide a clear understanding thereof. The exception which does not appear in the incorporated U.S. application is a thermostat 65 which is also designated TK is shown near the bottom of the machine room portion 34. The thermostat 65 is provided with a cold oil sensor 67 which is shown schematically as such penetrating into the interior of the oil reservoir 48. This representation is shown for purposes of function rather than to precisely locate the physical embodiment of the sensor 67 since the thermostat 65 may be physically attached to an exterior portion of the reservoir 48. The bottom portion of the reservoir 48 is choosen in order to sense a representative temperature of the hydraulic oil 46 by heat transfer through the wall of the reservoir 48 which provides within a reasonable range of accuracy, such as a fraction of a °F., the true temperature of the oil. The output of the thermostat 65 is connected to an input of the relay module 76 which is used to communicate to the microcomputer 80 through an input channel thereof which is isolated from noise effects as will be further described.

Figure 2:
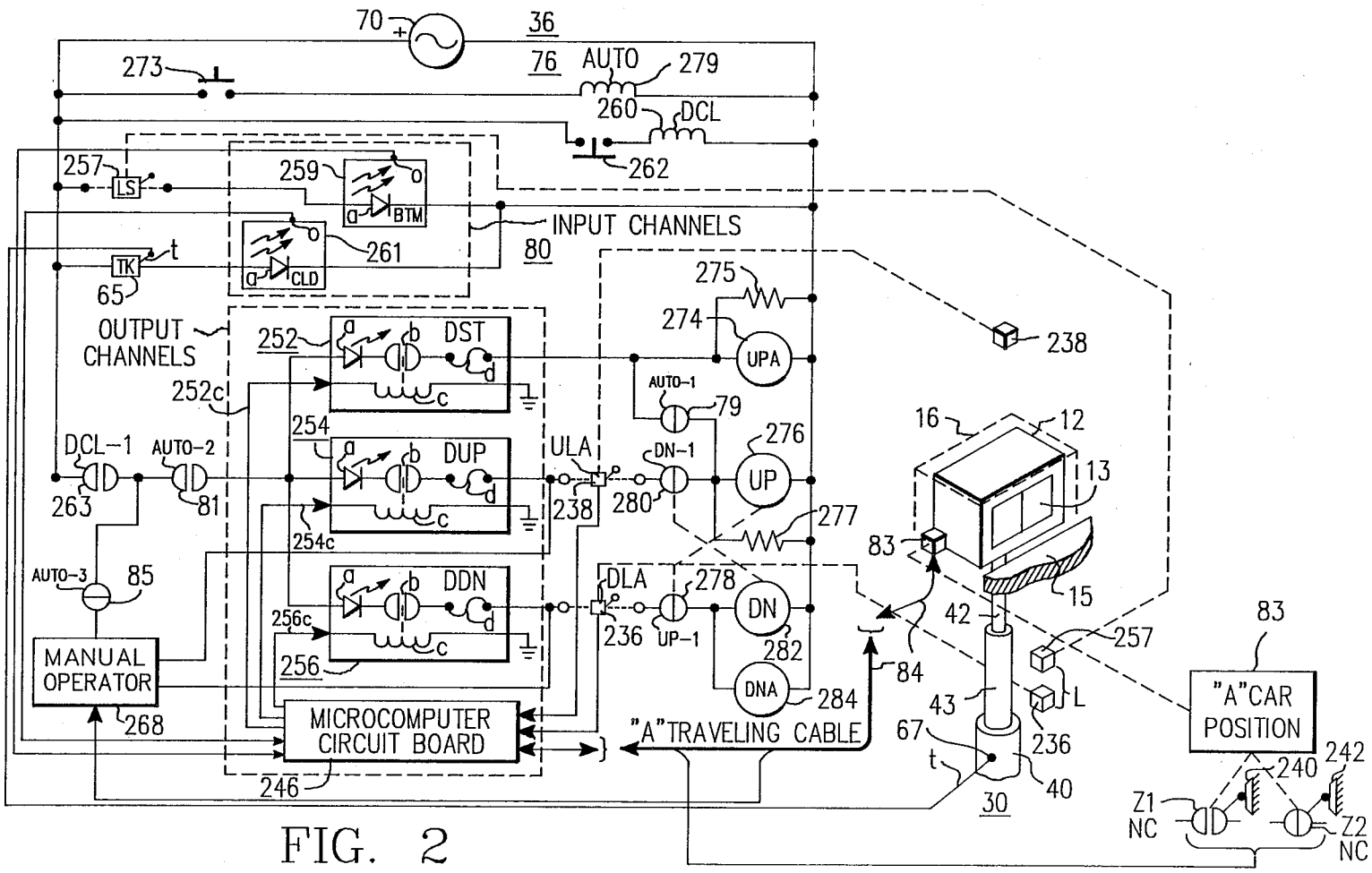
FIG. 2 is a schematic diagram of the present invention, including a microcomputer circuit interfacing with an elevator car, for controlling the recirculation of oil in the hydraulic system.

FIG. 2 shows within the footprint of stacked (dashed-block) rectangles defining input and output channel perimeters around the microcomputer 80, a group of Output Channels 252, 254, 256 which are associated with a microcomputer circuit board 246 and which are resident in closely spaced association for electric circuit operation therewith. The output channel blocks 252, 254, 256 are functionally representative of a type of solid-state electronic device which is capable of switching high or line voltage AC relays such as UPA motor control relay 274, UP valve control relay 276, DN valve control relay 282, respectively, which are electrically in circuit therewith between on and off states of operation. Gating logic voltages used are relatively low DC values of the type that are normally associated with microcomputer devices 246 in the present circuit arrangement. These solid-state transistor devices are resident on a single integrated circuit (IC) arrangement which may use the type of device known in the art as Silicon Control Rectifiers (SCR), Triacs, Thyristors, and, more recently, Gate Turn-Off devices (GTOs) which is an enhanced solid- state device providing the capability of starting and stopping the flow of high voltage AC waveforms within a fraction of a cycle of the 60 Hz waveform.

The output channel 252 is functionally represented by three elements in a series circuit with the first being a light-emitting diode (LED) 252*a*, a set of normally open contacts 252*b* which are controlled by a switching coil 252*c*, and a series fuse 252*d*. The acronym "DST" is used to represent the functional characteristic of this output channel 252 which is used to start the operation of the motor 52 in FIG. 1 which starts the pump 50 to push hydraulic oil through valves 58 in order to normally operate the hydraulic jack 40 as already described. Similarly, a DUP output channel 254 controls the UP relay coil 276 which controls the UP hydraulic valve resident in the valve unit 58 for normal movement of the elevator car in the upward direction when a DDN output channel 256 is not energizing the circuit of DN relay coil 282. This maintains the DN valve closed which is also resident in valve unit 58, so that hydraulic oil is retained under pressure by the hydraulic jack 40.

The mode of operation for upward movement of the elevator car 12 in the hatchway 16, as driven upward from landing 15 by the hydraulic jack 40 plunger section 42 and an intermediate plunger section 43 forcing this upward motion of car 12, has been described with respect to FIG. 6 in the incorporated U.S. application. This presumes the following two conditions: the elevator door 13 is in a closed position corresponding to DCL relay coil 260 being energized through a closed door switch 262 so as to close DCL-1 switching contacts 263, and the elevator system is set for automatic operation AUTO relay coil 279 being energized through auto switch 273 thereby closing AUTO-2 switching contacts 81 in order to provide an operating line voltage 70 of about 120 v AC across the relay coils 274 and 276. This voltage then energizes the energization for the normal upward car travel direction when the microcomputer circuit board 246 signals the output channels on the respective control lines 252*c*, 254*c* to complete the circuits for 274 and 276. This situation likewise presumes that the car 12 has not tripped the upper limit floor switch 238 which will open circuit the circuit between output channel 254 and the UP relay coil 276 to prevent further upward motion. This was further described in the incorporated U.S. application which also completely described the operation of the DDN output channel circuit 256,282 and the operation for downward motion of the elevator car 12, except there was no mention of the cold oil recirculation circuits of the present invention and the interactive program functions through the microcomputer circuit board 246 with further reference to FIG. 2 of the present description.

The microcomputer 80 shows within the footprint of the smaller rectangle of dashed lines Input Channels 259 and 261 which are associated with the microcomputer circuit board 246. These inputs 259, 261 are functionally representative of a type of solid-state electronic device which can optically isolate a high or line voltage AC input and provide a low voltage DC output which forms logic signal information to the microcomputer circuit board 246. The input channel 261 is represented by an element 261*a* which is recognizable in its functional character as a light-emitting diode (LED) which provides light as output waves designated by the pair of arrows. When the light waves are received by a photosensor terminal designated 261*o*, an output signal is generated of a low voltage DC value which is responsive to the cold oil thermostat 65 by a contact closure. The acronym "CLD" will be used for the functional designation of input channel 261. The TK thermostat 65, which has been previously discussed with respect to FIG. 1, is shown in series circuit with the CLD input channel 261 connected across the source 70 of AC line voltage, and the coil oil sensor 67 is shown in relation to the hydraulic jack 40 which may be taken to represent a location on the wall of the reservoir 48 which has been abbreviated from this representation of the system shown in FIG. 1. The operation of the thermostat 65 when it senses a temperature "t" of hydraulic oil in the reservoir which is below some standard operating value, which may be for example 70° F., will cause the switching contacts of TK thermostat 65 to close so as to complete the input circuit of CLD input channel 261. This will couple the output light signal to output line 261o and form a high DC input to the microcomputer circuit board 246.

The other input channel 255 has identical elements to that of input channel 261 and is functionally designated "BTM" in order to represent that the output signal 255*o* is recognized when car 12 is at a predefined position in the hatchway 16 which is indicated by the position of a limit switch 257 located in the hatchway a predefined distance "L" vertically displaced from a lower limit floor switch 236, where it may be for example 18 inches thereabove. The limit switch 257 may correspond to a slowdown limit for the car to begin its slowdown from running speed to landing speed at the bottom floor so that its contacts are normally closed except when the car is within 18 inches from the bottom floor. When the car 12 is at the bottom floor the LS limit switch 257 opens its contacts to open circuit the BTM input channel 255 so that a low DC output signal 255*o* is signaled to the microcomputer circuit board 246. This information pair with the elevator car 12 at the bottom floor is necessary so that circulation of oil in the reservoir 48 may be initiated when the TK thermostat 65 signals that the oil temperature "t" is below the standard operating condition. The operational program module CLDOIL as it will be described with respect to FIG. 5 will show the sequence of operation after the elevator car 12 is brought to the bottom floor when the TK thermostat 65 signals the oil is cold so long as the car is in service and available and as further explained with reference to the microcomputer circuit board 246.

FIG. 3 shows the micro-computer circuit of block 246 of FIG. 2 in a more detailed block diagram which is a special purpose microprocessor-based controller designed to control the overall operation of a single car 12 in the hydraulic elevator system 10 via a bi-directional communication path in the traveling cable 84. A similar bi-directional communication path for the corridor fixture signalling functions such as pushbutton hall calls 118, visual lanterns 114, horizontal position indicators 122 and audible car position signalling is provided over the HOISTWAY DATALINK 82 which communicates with a central processing unit (CPU) 286 through a serial input/output controller 296 through an ADDRESS bus 300, DATA bus 302, and CONTROL 304. The CPU 286 is a highly-integrated 8-bit CPU that is designed to operate at 6 MHz operating speed, and a CPU of this type is available from INTEL with a Model No. 80188. The micro-computer circuit within block 246 is substantially the same functional unit described in FIG. 7 of the incorporated U.S. application with the exception that there are two additional inputs to a relay buffer input/output circuit 298 with one coming from the BTM input channel 259*o* and the other from CLD input channel 261*o* which have both been described previously in FIG. 2.

Also in the circuit with the CPU 286 is an EPROM memory 292 which is split into two sections which can both either be 32K or 16K bytes of the same type of programmable "read only" memory. This memory is available for storage of the main processing functions which are sequentially stepped through by the CPU 286 as a chain of continuous subroutines for operating the hydraulic elevator system in its various car signalling, control, and strategy functions as well as for corridor signal processing functions. Exemplary of these subroutine functions which rely on input signal information communicated to the CPU 286 through the relay buffer 298 and serial controller 296 input/output functions are a normal running routine, door opening routine, car call routine, and corridor call processing routine. Another important routine which is programmed into the EPROM 292 is a module or modular routine or subroutine module referred to as the "cold oil start" routine or simply "CLDOIL" as it is shown at the top left in the flow chart of FIG. 5 within label 319 and used for the purpose of sequencing the CPU 286 of the micro-computer circuit 246.

FIGS. 4A, 4B, and 4C each form a portion of a RAM map for the data storage device known as a random access memory (RAM) 294 which is also a part of the microcomputer circuit 246 of FIG. 3. The RAM memory 294 can provide 8K bytes of data storage and can retain approximately 2K bytes of data in extended non-voltage type long-term storage in the absence of any operating supply voltage except for a long-term shelf life storage battery. FIG. 4A is shown with a bit configuration for either of two possible states of the TK thermostat 65, with the top row of 00 being interpreted by the CPU 286 as the bit configuration for the oil not cold which can mean for example 70° F. or above. The lower row bit configuration 01 is interpreted by the CPU 286 as a bit configuration for presenting that the oil temperature is below the last value given and not taken as the minimum operating temperature of oil for the hydraulic elevator system 10.

The random access memory 294, which may also be termed a working memory for the CPU 286, also provides program status related semaphores or flags which are useful for logical program sequencing which is the case for the cold oil flag a shown in FIG. 4B. The top row of bits 00 is interpreted by the CPU 286 to mean that the cold oil flag is expired, a condition that will have added meaning as it relates to the flow diagram of the module CLDOIL shown in FIG. 5. Likewise, the second row of bits 01 is a bit designation for bypassing oil which is a condition during which the cold oil thermostat flags are less significant at least for the minimum counting time period when the oil recirculation or bypassing of oil is timing or counting down to 0. The third row of bits 10 for the cold oil flag is designated "min expired" which is interpreted by the CPU 286 to mean that the minimum timer has expired which may further mean that the maximum timer has begun to count time and is counting down to 0.

Another possibility is that the maximum timer has begun its countdown but that the circulation or bypassing of oil has been terminated which is the case if the cold oil thermostat bit pattern is interpreted by the CPU 286 as 00 for oil not cold after the minimum timer has counted down to 0. The bit configuration in the last row 11 of the cold oil flag is not used for these purposes by the program module CLDOIL.

FIG. 4C shows the construction of a full word consisting of two bytes for the Cumulative Timer Counter which also utilizes RAM 294 in order to provide a program type counter or software counter which may be set at different stages to two different time intervals simply by the program insertion of a number corresponding to the length of time that the timer is to be active. Each byte of the word consists of 8 bits with the lower byte occupying the bit positions in the right-most rectangle of seven adjacent blocks of each word and the least significant bit designated as LSB. The minimum timer is shown with the lower byte of the word set for 11110000 binary which corresponds to FO hexidecimal (HEX), also corresponding to DECIMAL 240. A counter may be set to count at 0.5 second intervals, so for counting down from 240, the time it would take would be 120 seconds or 2 min. which is the time chosen for this example for the minimum timer.

A new word may be added to the timer as shown for the max timer with the bit configuration in the lower portion of FIG. 4C which has a lower byte 01101000 and an upper byte 00000001 adjacent to the lower byte to provide the binary number corresponding to 168 (HEX), which corresponds to DECIMAL 360. The counting down from 360 by this timer in 0.5 second counts takes 180 seconds or three minutes which is the time accumulated by the maximum timer for recirculating or bypassing oil giving a total time of 5 minutes if both time phases of the timer are used. This amount of time is the total available time to be interactively sequenced by the CPU 286 within the hydraulic elevator system parameters and the sequencing of the program module CLDOIL.

Figure 5:
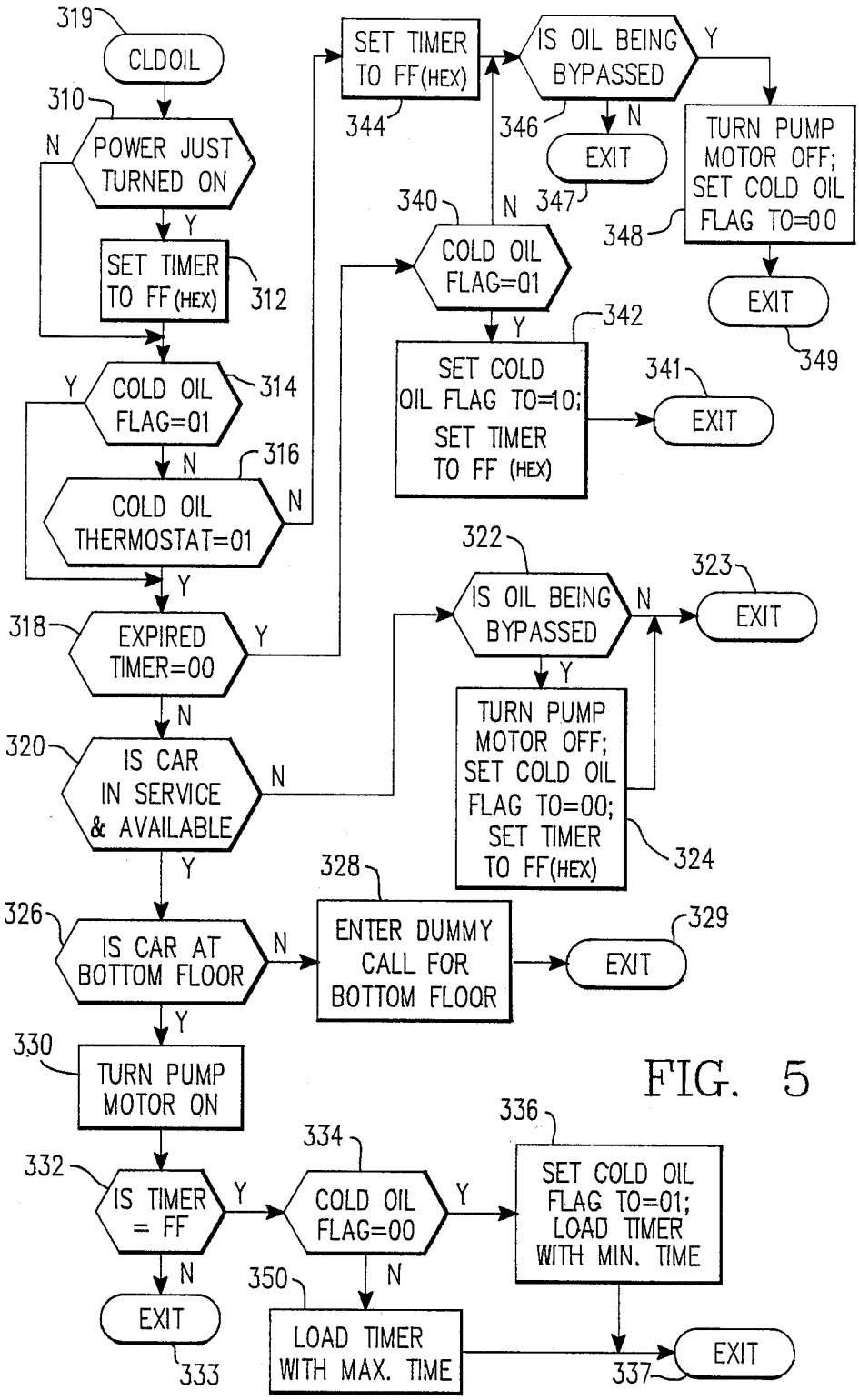
FIG. 5 is a flow chart of a program module CLDOIL with its associated sequencing routine which is programmed into the EPROM within FIG. 3 and run in the microcomputer circuit in a repeating sequence with other program modules.

Referring now to the flow chart of FIG. 5, the CPU 286 begins the serial sequencing at the top left label 319 designated CLDOIL and proceeds to make a pass through various decision and action steps which are each contained within a hexagon-like container for the decision steps 310 and rectangular-type containers for the action blocks 312 in a traverse of the flow diagram. In reaching a label 333 designated as EXIT the CPU 286 will proceed serially to step through any relevant program routines which are designated to be sequenced during the time that the CLDOIL module is being run to provide recirculation or bypassing of oil in order to warm the oil up to the operating temperature standard which will be assumed for purposes of example to be 70° F. It is important to understand that there are primary chains of sequencing which will be broadly discussed in relation to the system operation which is represented in the flow chart of FIG. 5.

The first of these chains choosen begins with a decision step 310 which checks to see if the power has just been turned on in the elevator system and exits at label 337 after sequential traversing all of the decision steps and action blocks in their proper sequence in this dogleg column of steps. Since the power has just been turned on at 310, the answer is yet "Y" so that action block 312 sets the timer to FFFF which is a hexadecimal number represented in binary as number with sixteen 1 bits which is used to designate a condition of the timer of FIG. 4C being set to a disabled state. As an abbreviation for the full hexadecimal number for the disabled state, the flow diagram âbbreviates the same for convenience to be recognized from the designation in block 312 and others as FF (HEX). The exit sequence form action block 312 is through decision step 314 which checks if the cold oil flag=01 and is answered in the negative since the cold oil flag shown in FIG. 4B has not been previously set to the binary bit configuration 01 if the power has just been turned on. The next decision step 316 checks to see if the cold oil thermostat=01 which corresponds to the oil is cold bit configuration shown in FIG. 4A as will be assumed since the system power has just been turned on. The next decision step 318 checks to see if the timer has expired=00 which is answered in the negative since in action block 312, the timer was set to its disabled state FF. The negative exit from decision step 318 is followed by decision step 320, checking to see if the car is in service and available which will be answered in the affirmative.

A car is available by determining whether the following conditions are met: it is not running, the doors are closed, no car calls or hall calls are present, and the car is in a level zone at a landing. If the car is not in service and available, there would be little favor in providing a recirculation or bypassing of the hydraulic oil in order to provide the proper oil viscosity for smooth starts. It should be remembered, this is hereby done without the need for a separate heater in the hydraulic oil reservoir which is a special advantage of the present invention.

If, however, the car is not in service or not available for some other reason such as servicing or otherwise, a negative decision proceeds to the right to the decision step 322 which checks to see if oil is being bypassed in FIGS. 1 and 2 by the operation of both the UP coil 276 energized by output channel 254 to hold the UP valve in block 58 of FIG. 1 in its de-energized state at the same time that the DN coil 282 is de-energized by the output channel 256 to hold the DN valve in block 58 inactive. This is done while the UPA coil 274 is energized by the output channel 252 to energize the line starter 74 and pump motor 52 in order to drive the pump in an oil recirculating mode from the reservoir 48 through the block of valves 58 and back into the reservoir through pipe 62 without reaching the hydraulic jack 40 in this process. Since the power has just been turned on, there is little reason why the decision step 322 should be affirmative so that exit is through label 323 from the program sequence. But in the event that the pump motor 52 had been previously turned on with the decision step 320 having a positive outcome, the output sequence of decision step 322 would be through action block 324 in order to turn the pump motor off and also to set the cold oil flag to=00 which is the expired bit pattern, and the timer is also set FF for the disabled state.

If the car should be back in service and available at step 320 on the next sequencing through CLDOIL, all of the steps preceding decision step 320 would provide the same outcome and the affirmative answer of step 320 would then proceed to the next decision step 326 which checks to see if the car is at the bottom floor of the building structure. If it is not, the path of exit is to the right and to action block 328 which enters a dummy call for the bottom floor before exiting at label 329. The CPU 286 responds to the dummy call entry of block 328 through sequential operation of the call routine and running routine modules in order to send the elevator car 12 to the bottom floor. The door opening routine is set so that the door or doors of the elevator car are signalled to be closed while the car is at the bottom floor during the oil recirculating or bypassing mode according to the invention.

When the car is in position at the bottom floor, a condition which is recognized by the microcomputer circuit 246 by the low state of input channel 259*o*, explained with respect to FIG. 2 previously, the decision step 326 is exited below it with an affirmative and the action block 330 turns the pump motor on and the UP and DN valves are both inactive for oil to recirculate. The decision step 332 then checks to see if the timer=FF which is the disabled state and which is responded to in the affirmative since it has been set to this state in action block 312 or 324, the latter situation corresponding to a negative response of step 310 in the alternative. The decision step 334 checks to see if the cold oil flag=00 which is the expired condition for this flag and is the likely condition for it since the program sequence has not set it yet to an alternative binary pattern assuming the power has just been turned on or that no sequencing has occurred in action block 324 or similarly in block 348 as later described. The decision at step 334 is affirmative to the right and action block 336 is designated to set the cold oil flag to=01 as a bit pattern which represents bypassing oil corresponding to the pump motor having been turned on at block 330, and the timer is loaded with the minimum time which was previously chosen to be a count of 240 corresponding to 120 seconds or two minutes. The exit from block 336 is through label 337 with the timer counting in real time.

The execution of the program proceeds in sequence back to the start at the decision step 310 which is answered in the negative or to the left in order to go to the decision step 314 which is now answered in the affirmative since the "oil flag" was set to=01 at block 336 and will remain so for the duration of the minimum timer counting or about 2 minutes in any event. During this period of time, the chain of sequencing proceeds without checking the status of the cold oil thermostat at decision step 316 since the minimum timer has been set, and the timer is not expired at decision step 318 until the timer out of same. So during this interim of time, the sequencing continues through decision steps 320, 326 in the affirmative, with the pump motor being left on at block 330, but now the timer is no longer disabled=FF since the timer has been loaded with the minimum time in block 336. The negative exit through step 332 proceeds out of the exit label 333. This pattern continues for about two minutes with the cold oil flag=01 until the decision step 318 checks to find that the timer has expired=00 and exits to the right and upward to decision step 340 which checks to see if the cold oil flag=01. Since the answer is affirmative, the exit is downward into action block 342 which sets the cold oil flag to=10 bit pattern to designate that the minimum time has expired, as in FIG. 4B. The timer is set=FF which is the disabled state for same and may be a temporary condition preceding the setting of the timer for the maximum time counting extension of the minimum time counting which will be after the exit through label 341.

The sequence starting at the top left continues by the action of the CPU 286 again sequencing through step 310 negatively and step 314 finding the cold oil flag=01 in the negative since it has been set=10 in block 342, and the decision step 316 at this point is assumed to no longer be indicative of an input signal from the cold oil thermostat=01. This assumes that two minutes of recirculation bypassing was sufficient to heat up the oil temperature to the established minimum operating standard. In this event, the exit of decision step 316 is negative and to the right into action block 344 which sets the timer to FF in order to disable it, and the decision step 346 checks to see if oil is being bypassed and is affirmative, so the action block 348 turns the pump motor off since it is no longer needed for the warming operation and the cold oil flag is set to=00 for the exit from the program at label 349.

This minimum timer operation followed by the proper oil temperature needed is normal but is not always the situation since a hydraulic elevator system is often slated for use in climates where the temperature of the oil may be somewhat lower. A cumulative minimum plus maximum timer operation has been found to provide an enhancement of the method of heating oil which assures the maintenance of proper oil viscosity and minimum maintenance requirements. It should also be noted that this sequence of decision paths through steps 344, 346, 348 may be taken subsequent to the initiation of maximum timer time count since the decision step 316 is requested each cycle of sequencing, after the minimum timer chain exits at 341 and until the maximum timer chain exits at 349, as will be more clearly seen from the following description.

After the minimum timer exit at label 341 with the timer set to be disabled and the cold oil flag set to=10 which was done in step 342, the sequencing was proceeding through decision steps 310 and 314 in the negative, and will now be considered for the situation where the cold oil thermostat=01 in the affirmative which is the bit signal for cold oil. This continues recirculating the oil in order to provide further warming of the oil up to the operational temperature desired has been reached. A decision step 318 decides in the negative since the timer has been disabled to FF in block 342, and the sequence through steps 320, 326 are affirmative with the pump motor continuing to operate through block 330, but now the decision step 332 checks and finds that the timer=FF for an affirmative exit to the right. Decision step 334 checks the cold oil flag=00 with the resulting negative as both of these steps have been predetermined by the setting in block 342. The negative exit from step 334 loads the timer with the maximum time in action block 350 which is an additional count of 360 DECIMAL equivalent to 180 seconds or three minutes timer counting extension beyond the original two minutes obtained from the minimum timer counting. The exit from block 350 is at label 337.

On the subsequent sequencing through CLDOIL, the decision step 316 is assumed to continue to be affirmative for the purpose of tracing the operation through to completion of the maximum timer counting, although the temperature of oil will at any moment provide an opportunity to exit through label 349 if the thermostat=01 in the negative. The affirmative exit of step 316 and with the timer=00 in the negative, since it is active, proceeds through the decision steps 320, 326 with the pump on in 330 and the check to see if the timer is=FF or disabled at step 332 negative with the exit through label 33. Sequencing along the path last described is repeated through this vertical column of steps unit such time as the step 318 indicates affirmatively that the timer has expired=00 with this exit leading to the right upper decision step 340 which checks to see if the cold oil flag=01. A negative response to present since the previous time-out of the minimum timer counting has set the cold oil flag to=10 in block 342. The negative exit from step 340 into decision step 346 checking to see if the oil is being bypassed is affirmative since the pump has been on continuously during the minimum and supplemental maximum time counting periods. The action block 348 turns the pump motor off and sets the cold oil flag=00 which is the exit state for label 349.

The next sequence for the steps 310, 314 continue to be negative with the great likelihood that the oil is no longer cold and step 316 is negative and proceeds through block 344 and the check to see if the oil is being bypassed at step 346 is now in the negative exit through label 347.

A failure mode which protects against an outstanding failure for a component is of great importance in this program module CLDOIL as next presented. The TK thermostat 65 with its sensor 67 failing in the cold oil signal condition=01 is next considered. The hydraulic elevator system according to this invention broadly protects against such a failure by the predetermined limited counting time for both the minimum and maximum timer phases. These each have a limited time duration which is not repeatable in the system after a once-through sequencing has take place, assuming that the power is either shut off or is not shut off to the system for any great length of time in the interim. The normal operation of the decision step 316 is in the negative after minimum time counting, but thereafter, is otherwise usually negative within the interim of maximum timer counting for sufficient warming. If there should be a failure in the thermostat with a signal for cold oil recirculation bypassing for a more extended time beyond the expired timer step 318, the negative cold oil flag=01 at step 340 ultimately turns the pump motor off in block 348.

The signal for cold oil from the TK thermostat 65 is therefor interpreted by the CPU 286 to be no longer credible until it goes through a transition from the binary state 01 to the state 00 in order for this signal to be trusted. The CPU 286 monitors this transition in the storage capabilities of the RAM 294 which is used by the program module CLDOIL resident in the EPROM 292. The temperature of the hydraulic oil is thus protected from reaching an overtemperature which could damage the windings on the pump motor 52. This protection is present not only in the environment of FIG. 1 with the pump 50 and motor 52 being submerged in the oil 46 of the reservoir 48, but also in convenientional hydraulic elevator systems.

This prevents a serious safety problem which would be present in the hydraulic elevator system when an overtemperature condition of the oil exists, in which event, this would require that you go out of service. This means for safety reasons you could not run the elevator car up but would bring the car down to the bottom floor, then open the doors and keep the doors open, and not allow any calls to be answered unless the safety situation was stabilized.

Another situation exists in day-to-day operation when the temperature of the oil is within a very close range of the pre-established minimum value which is used for the operating standard. Depending on the sensitivity reading of the thermostat, a flickering cold oil thermostat signal could occur which, if left unregulated, could cycle the pump motor 52 at a frequency causing damage to it and the line starter 74. An analog to this situation is with the use of a heating coil instead of the sensor monitoring system and method of the present invention which avoids the problem of overshoot heating cycles.

A heating coil design is conventional and is not considered an adequate solution to this problem which the present invention specifically overcomes by the provision of a minimum counting time for recirculation bypassing of oil. This protects the motor by a type of timed hysteresis effect in the manner of monitoring the thermostat 65 for the correct signal via the interactive program module CLDOIL.

We claim as our invention:

1. An elevator system in a structure, with the elevator being adapted to be hydraulically driven with prewarmed hydraulic oil obtained by operationally recirculating the cold oil in a reservoir, the oil otherwise being available for driving an in-service elevator car in the structure, said system comprising:

motor drive means having an output shaft for providing an output torque when said motor drive means is energized;

pump means movably coupled to the output shaft of said motor drive means for drawing through its intake the available hydraulic oil from the oil reservoir and being adapted to expel pressurized oil from its output;

hydraulic jack means having an oil input and output and a fluid chamber therebetween adapted to move the elevator car upwardly and downwardly to serve floors in the structure;

valve means including up and down control valves connected between the output of said pump means and the input of said hydraulic jack means, and said valve means being capable of returning oil to the reservoir;

thermostat means reponsive to the temperature of hydraulic oil for signaling a cold oil condition when the temperature of the oil is below an operating standard; and control means, responsive to the cold oil temperature signal from said thermostat means, through a control program module which interacts with the cold oil signal to activate the operation of said pump means for a time interval of a minimum program timer, through energization of said motor drive means for pumping oil to recirculate the oil from one portion of the reservoir, bypassing said hydraulic jack means, and return the oil to another portion of the reservoir during a predetermined sequence of timing counts so that the temperature of the recirculating oil is warmed up to the temperature minimum for elevator operation.

2. The elevator system of claim 1, wherein said control means includes a control circuit and a temperature input channel means for said control circuit, said temperature input channel means being connected to receive the signal for cold oil from said thermostat and to isolatingly couple the signaling of cold oil temperature to said control circuit in a coded format for input recognition by said control circuit, said control circuit being effective to shut down the operation of said pump means, without threshold minimum temperature recycling of said motor drive means.

3. The elevator system of claim 2, wherein said control means includes a position limit means which senses the position of the elevation car when the car is at a predetermined distance from the bottom floor of the structure, and position input channel means for said control circuit being connected to said position limit means to signal the position presence of said car at the bottom floor to said control circuit to begin recirculation of oil bypassing said valve means.

4. The elevator system of claim 1, wherein said motor drive means includes an electric pump motor in circuit with an electric line starter, said control means includes a microprocessor based computer circuit adapted to interface the input signal from said thermostat and to output a control signal to shut down the operation of said electric pump motor after recirculating the oil during the sequence of minimum timing counts without threshold minimum temperature recycling of said line starter and said pump motor.

5. The elevator system of claim 1, wherein said control program module which interacts with the cold oil signal from said thermostat serves as an input to begin a minimum timer counting phase for a sequence of timing counts throughout which time counts and program sequencing of said pump is activated through energization of said motor drive means to warm the temperature of oil in the direction of reaching the temperature minimum.

6. An elevator system in a structure, with the elevator being adapted to be hydraulically driven with prewarmed hydraulic oil obtained by operationally recirculating the cold oil in a reservoir, the oil otherwise being available for driving an in-service elevator car in the structure, said system comprising:

motor drive means having an output shaft for providing an output torque when said motor drive means is energized;

pump means coupled to the output shaft of said motor drive means for drawing through its intake the available hydraulic oil from the oil reservoir and being adapted to expel pressurized oil from its output;

hydraulic jack means having an oil input and output and a fluid chamber therebetween adapted to move the elevator car upwardly and downwardly to serve floors in the structure;

valve means including up and down control valves connected between the output of said pump means and the input of said hydraulic jack means, and said valve means being capable of returning oil to the reservoir;

thermostat means responsive to the temperature of hdyraulic oil for signaling a cold oil condition when the temperature of the oil is below an operating standard; and control means responsive to the cold oil temperature signal from said thermostat means to activate the operation of said pump means through energization of said motor drive means for pumping oil through said operational valve means to recirculate the oil from one portion of the reservoir through the valve means; said control means including a program module which interacts with the cold oil signal from said thermostat which serves as an input to begin a minimum timer counting phase for a sequence of timing counts throughout which time counts and program sequencing of said pump is activated through energization of said motor drive means to warm the temperature of oil in the direction of reaching the temperature minimum by bypassing said hydraulic jack means, and return the oil to another portion of the reservoir during a predetermined sequence of timing counts so that the temperature of the recirculating oil is warmed up to the temperature minimum for elevator operation.

7. The elevator system of claim 6, wherein said program timer module includes a maximum timer phase which is optionally initiated by the cold oil signal from said thermostat, as an extension of the minimum timer phase for an extended sequence of timing counts throughout which cumulative time said pump is activated through continuous energization of said motor drive means to further warm the temperature of oil to reach the temperature minimum, without incurring overheating of the oil, and thereafter shutting down said motor drive means for said pump means to begin normal elevator service.

8. The elevator system of claim 7, wherein said program module includes an exiting timer phase which is activated after the expiration of timing counts of the minimum timer phase which is fully sequenced for warming the oil the minimum time, said exiting timer phase thereafter interacting with the signal from said thermostat either remaining unchanged or changing to the inverse signal if oil is not cold, which occurs upon the temperature of oil reaching the temperature minimum, said exiting timer phase shutting down said motor drive means upon the input of the inverse signal from said thermostat.

9. The elevator system of claim 8 wherein said exiting timer phase of said program module allows the extended sequence of timing counts for the maximum timer phase throughout which said pump means is activated through continuous energization of said motor drive means, and thereafter said pump means being shut down in any event such as failure of said thermostat to signal the inverse signal if oil is not cold any longer as when the operating temperature of the oil has been reached.

10. A method of operating a hydraulic elevtor system in a structure, with the elevator being adapted to be driven by a hydraulic jack with prewarmed hydraulic oil obtained by operationally recirculating the cold oil in a reservoir, the oil otherwise being available for driving an in-service elevator car in the structure, said method comprising the steps of:

providing motor drive means having an output shaft for producing an output torque when said motor drive means is energized;

providing pump means rotationally coupled to the output shaft of said motor drive means for drawing through its intake the available hydraulic oil from the oil reservoir and expelling pressurized oil from its output after a vertical rise;

providing valve means including up and down control valves connected between the output of said pump means and the input of said hydraulic jack, and said valve means returning oil to the reservoir;

providing thermostat means responsive to the temperature of hydraulic oil for signaling a cold oil condition when the temperature of the oil is below an operating standard; and providing control means interacting through control programming reponsive to the cold oil temperature signal from said thermostat means to activate the operation of said pump means for a time interval of a minimum program timer by energizing said motor drive means for pumping oil through said operational valve means to recirculate the oil from one portion of the reservoir through the valve means, bypassing said hydraulic jack means, and return the oil to another portion of the reservoir during a predetermined sequence of timing counts so that the temperature of the recirculating oil is warmed up to the temperature minimum for elevator operation.

11. The method of claim 10 including the step of optically coupling the signal for cold oil from said thermostat means to said control circuit in a coded format for input recognition by said control means, said control means being effective to shut down the operation of said pump means, without threshold minimum temperature recycling of said motor drive means.

* * * * *